United States Patent [19]

Ebeling et al.

[11] 4,107,929

[45] Aug. 22, 1978

[54] RAIN WATER ROOF OUTLET OR SIMILAR FOR A BUILDING

[75] Inventors: Martti Olavi Aladar Ebeling; Risto Waldemar Lundén, both of Helsinki, Finland

[73] Assignee: Kontekla Oy, Helsinki, Finland

[21] Appl. No.: 808,349

[22] Filed: Jun. 20, 1977

[51] Int. Cl.[2] ..... E02B 5/08; E02B 9/04

[52] U.S. Cl. ..... 61/14; 52/12; 210/163

[58] Field of Search ..... 61/14, 15; 52/12, 16, 52/11; 210/163, 164, 165, 166, 460

[56] References Cited

U.S. PATENT DOCUMENTS 803,316 10/1905 Vogel ..... 52/16

FOREIGN PATENT DOCUMENTS

R16282 10/1956 Fed. Rep. of Germany ..... 210/166

*Primary Examiner*—Jacob Shapiro

*Attorney, Agent, or Firm*—Cushman, Darby & Cushman

[57] ABSTRACT

A rain water outlet for a roof of a building comprising a vertical pipe and a trough fixed to the upper end of said pipe. A lid is fastened in the trough above the inlet end of said pipe. The lid forms a closed surface larger than the inlet end to cause water to flow radially in the trough to said inlet end and to prevent axial suction of air into the pipe. A sieve is positioned between the lid and the bottom of the trough to surround said inlet end. The sieve is provided with perforations through which water flows from the trough into said inlet end. The relation between the total area of the perforations of the sieve and the cross-sectional area of the outlet pipe is between 2.5 and 3.5.

1 Claim, 3 Drawing Figures

RAIN WATER ROOF OUTLET OR SIMILAR FOR A BUILDING

Figure 1:
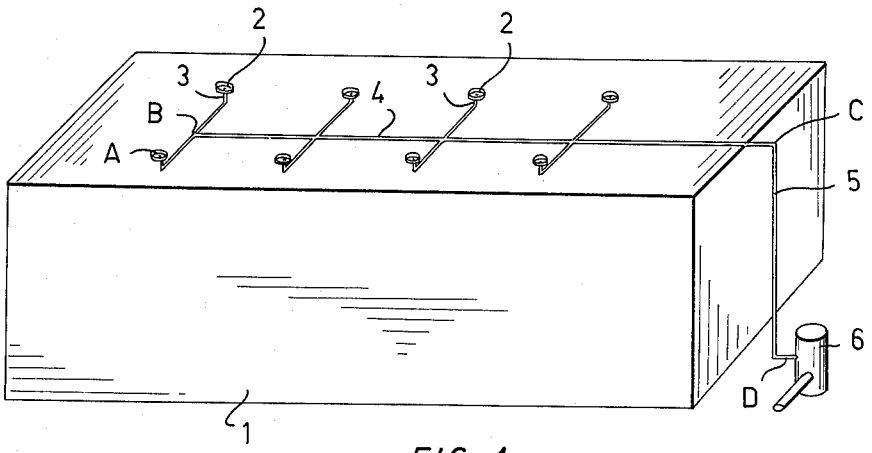

The present invention relates to a rain water roof outlet or similar for a building, comprising an outlet pipe leading from a roof or some other collecting area to a discharge point, a trough connected to the upper end of said pipe, said trough being wider than the mouth of the pipe, the free upper edge of said trough being located at a higher level than the mouth of said outlet pipe, a lid provided with a closed top surface and fastened above said mouth, said lid being wider than the mouth but smaller than the trough, the lower edge of said lid being located below the upper edge of the trough to prevent the formation of an air whirl in the outlet pipe while the trough is filled with water, and a sieve extending between said lid and the bottom of said trough, said sieve surrounding the mouth of the outlet pipe and being provided with perforations.

By means of such a construction of the roof outlet there are provided at the mouth of the vertical pipe such conditions that the flow of water in the vertical pipe takes place as an airless flow, i.e. as a solid water flow across the entire cross-section of the pipe, whereby the diameter of the vertical pipe can be dimensioned essentially smaller for a specific rain water quantity to be discharged per unit of time than in conventional rain water roof outlets.

When the outflow of rain water occurs as a solid flow the vertical pipe is thus completely filled with water and the total difference in height from the roof to the discharge point, which is normally located below the street level, corresponds to the stativ pressure of airless water and can be utilized for pressure losses produced in the rain water conduit and parts thereof.

The solid flow has the considerable advantage as compared to other systems that even very wide roofs, 5.000 to 20.000 sq.m. and more, can be drained by collecting the water amounts flowing to the roof outlets into a horisontal conduit running centrally immediately below the roof, said conduit extending downward only at the gable of the building or at some other suitable point, penetrating the ground level and ending at a discharge point. Hereby the commonly used numerous vertical rain water outlet conduits inside the building as well as the manifolds positioned under the ground level and based on discharge by gravitation can be entirely avoided, which conduits and manifolds besides being expensive are also bulky because they operate according to open flow and the transport of water is carried out on the basis of the inclination of the conduits.

Because the ability of the said flow system to carry water in an outlet conduit extending approximately in plane with the roof is based on the pressure produced by the difference in height between the roof and the discharge point, the upper parts of the rain water outlet conduit will be subjected to a static pressure which is considerably lower than the air pressure, and the lowest pressure will in general prevail at the point where the horisontal collecting conduit running under the roof changes its direction from horisontal to vertical. If said height difference in height is more than approx. 10 m, the rain water conduit is to be dimensioned so that at the point of the lowest pressure the sum of the static pressure and air pressure is not smaller than the steam pressure of the rain water (the static pressure is at the point of the lowest pressure negative) because, if said sum is smaller than said steam pressure, the water at said point begins to vaporize and to form steam bubbles in the conduit, wherefore the solid flow dimensions no longer hold true. For this reason, the maximum allowable pressure loss in the horisontal conduit portion is in practice about 10 m water column (about 1 bar).

Because the resistance causing said pressure losses is composed of both the friction of water against the pipe and the resistance of the pipe deformations (changes in direction, diameter etc.) and especially of the roof outlet, the resistance of the roof outlet should be made reasonably small.

One typical way to keep the resistance of the roof outlet small would be to enlarge the area of the sieve in the roof outlet by enlarging the roof outlet while still maintaining its capability to prevent entering of air into the outlet. The enlargement of the diameter of the roof outlet, however, results also in an increase in the depth dimension of the outlet, and the installment of a sufficiently big outlet in the roof becomes impossible. On the other hand, the enlargement of the perforation area of the sieve by means of increasing the size of the individual holes is not possible because the sieve portion must have a pipe protecting property such that all dirt particles passing through the perforation of the sieve also pass through the rain water conduit itself without clogging the conduit. Moreover, the enlargement of the total cross-sectional area of the perforations increases the risk of air being carried along, which phenomen cannot be allowed in a solid flow system. In addition, the sieve position still must have a sufficient strength against stresses applied to the sieve, e.g., against treading.

The Swedish patent publication No. 362,678 discloses a roof outlet, wherein the sieve above the outlet pipe is provided with a perforation. When measured from the figures shown, the relation between the total area of the perforations in the sieve and the cross-sectional area of the outlet pipe is about 2.2 and as small as about 1.85, respectively. The structures shown in the Swedish patent publication result in so big flow resistances, that larger diameters are used for the pipes in order to keep the total flow resistance within reasonable limits, which is an uneconomical solution, as already described above.

It is the object of the present invention to provide a rain water roof outlet, wherein the resistance of the outlet has been reduced without interfering with the capability of the roof outlet to provide a solid outflow of water. This is accomplished by means of a roof outlet according to the invention, which is characterized in that the relation of the total area of the perforations in the sieve to the cross-sectional area of the outlet pipe is between 2.5 and 3.5.

Experiments made with the roof outlet according to the invention have proved that a flow resistance of about 5 percent of the flow resistance of the conduit portion subjected to the lowest pressure can be allowed to the roof outlet without any difficulty. In this way, the resistance of the roof outlet can be reduced to a minimum, whereby the relation of the total area of the perforations in the sieve to the cross-sectional area of the outlet pipe has become decisive. The resistance number of the roof outlet is calculated from the formula $$R = 0.5 + R_p((F_i/F_o))^2 \quad (1)$$

where $F_l$ = cross-sectional area of the pipe
$F_o$ = area of the sieve perforations
$R_p$ = resistance number of the sieve perforations at a predetermined flow velocity through the sieve perforations = 0.5 + 1.1 = 1.6.

The total flow resistance produced by the roof outlet is $$\Delta p = R = (v^2 w/2g) \quad (2)$$

where
$v$ = flow rate in pipe
$w$ = weight by volume of flowing fluid
$g$ = acceleration The most common flow rates in the pipe are about 4 m/s, whereby the above mentioned pressure loss ($\Delta p$) sets the limits to R. At the worst, the flow resistance of the pipe postion subjected to the lowest pressure is 10,000 mm water column, of which 5 percent i.e. the allowable flow resistance of the roof outlet is 500 mm water column.

If R can be kept between the values of 0.63 to 0.75, the result is very advantageous regarding the roof areas to be drained with one roof outlet as well as regarding the required pipe diameters and, on the basis of formula (I), the conclusion is that the relation between the perforation area of the sieve and the cross-sectional area of the pipe has to be from 2.5 to 3.5.

Figure 2:
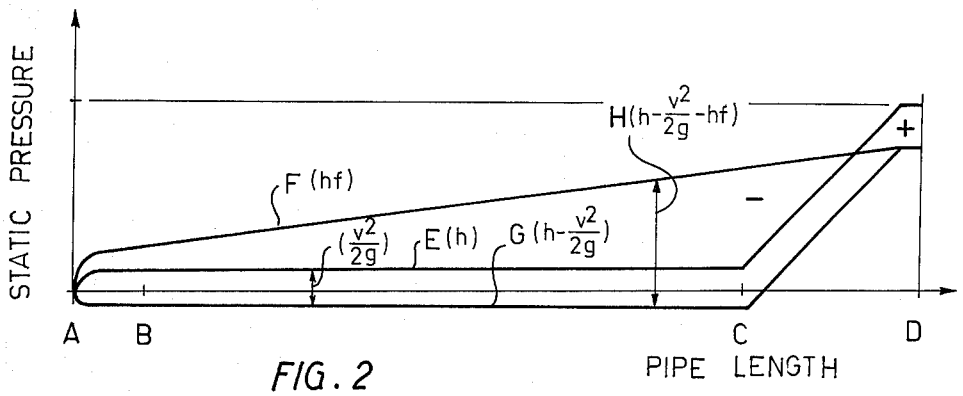
Figure 3:
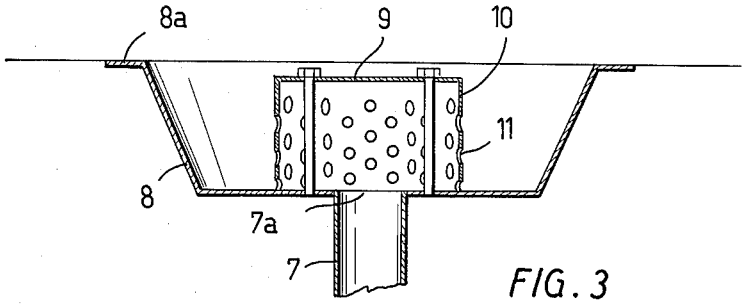

The invention will now be described in more detail in the following with reference to the accompanying drawing, where FIG. 1 is a schematic view of a rain water pipe system of a building provided with roof outlets, FIG. 2 is a diagram illustrating the pressure distribution in the pipe as a function of the length of the pipe, and FIG. 3 is an axial section of one embodiment of a roof outlet according to the invention.

The rain water pipe system shown in FIG. 1 of the drawing comprises a number of roof outlets 2 positioned on the roof of a building 1 and connected by means of pipes 3 to a collecting pipe 4 leading via a vertical pipe 5 to a collecting well 6.

In the diagram of FIG. 2, there is shown the actual static pressure in the rain water pipe starting from an outlet A $$(p/w) = h - (v^2/2g) - hf,$$

where $h$ = difference in height between the roof outlet and the pipe,
$v$ = flow rate in the pipe,
$hf$ = flow resistance,
$w$ = weight by volume,
$g$ = acceleration at the roof outlet (A), at the junction of the connecting pipe and collecting pipe (B), at the junction of the collecting pipe and the vertical pipe (C) and at the collecting well (D). In the diagram, curve E shows the static pressure due to the difference in height between the roof outlet and the pipe, curve F the flow resistance of the pipe and curve G the stativ pressure less the dynamic pressure. The vertical distance H between the curves F and G indicates the actual static pressure of the rain water pipe.

FIG. 3 shows a roof outlet comprising an outlet pipe 7, the upper end of which is connected to a trough 8 which is wider than the mouth 7*a* of the pipe. The free upper edge 8*a* of the trough is located at a higher level than the mouth of the outlet pipe. A lid 9 with a closed top surface is fastened above the mouth, said lid being wider than the mouth but smaller than the trough. The edge of the lid is located below than the upper edge of the trough. The lid prevents air from entering into the outlet pipe and, accordingly, the formation of an air whirl when the water level is located above the lid in the trough so that the flow of water in the outlet pipe takes places as a solid flow of water. To the lid is connected a sieve 10 surrounding the mouth of the outlet pipe and provided with perforations 11. The relation of the area of the perforations 11 to the cross-sectional area of the outlet pipe 7 is between 2.5 and 3.5.

EXAMPLE

The diameter of the perforation 11 in the sieve 10 is chosen to be 12 mm because it has been established experimentally that, by using perforations of said diameter, all dirt particles passing through the sieve also pass through the rain water conduit, wherefore there is no risk of clogging in the pipe. In a sieve provided with perforations of this size and made strong enough to meet the strength requirements, the relation between the total area of the sieve and the total area of the perforations in the sieve is about 3.

The diameter of the pipe 7 is 47 mm, whereby the cross-sectional area of the pipe is 17.35 sq.cm. If the relation $F_o/F_l$ between the total area of the perforations in the sieve 10 and the cross-sectional area of the pipe 7 is 3, the area of the perforations of the sieve is 52 sq.cm. and the total area of the sieve 156 sq.cm. The height of the sieve will be, considering the distribution of the perforations, 58 mm and the diameter 84 mm.

If the relation $F_o/F_l$ is increased, e.g., to the value 4, $F_o$ will be 69.4 sq.cm. and the total area of the sieve 208 sq.cm, whereby the sieve dimensions will increase to the values height 70 mm (20 percent) and diameter 95 mm (13 percent). The dimensions of the trough 8 then increase correspondingly and the installment of such a trough on a roof will be much more difficult. On the other hand, if the height of the sieve is kept unchanged, the diameter thereof would increase to the value of 114 mm i.e. 36 percent. For this reason, the area relation between the perforations of the sieve 10 and the pipe 7 must not be increased to exceed said upper limit.

On the other hand, a reduction of said relation $F_o/F_l$ below said value 2.5 will result in such a big increase in the flow resistance of the outlet 2 itself that, in order to keep the total flow resistance unchanged, the increased outlet resistance must be compensated by means of reducing the pipe resistance which is effected by increasing diameter of the pipe. In one example, the successive diameters of the horizontal collecting pipe sections are, when the number of outlets connected thereto is 5, as follows: 65.3 mm, 103 mm, 103 mm, 150 mm, and 150 mm. If the relation $F_o/F_l$, for example, is 2.4, the pipe diameters would have to be as follows to obtain the same flow resistance: 68 mm, 103 mm, 103 mm, 150 mm, and 150 mm. Thus, to compensate the increased outlet resistance, the diameter of one section of the collecting conduit would have to be enlarged.

The drawing and the accompanying specifications are only intended to illustrate the invention. In its details, the roof outlet according to the invention may vary considerably within the scope of the claims.

What we claim is:

1. A rain water roof outlet for a building, comprising an outlet pipe leading from a roof or some other collecting area to a discharge point, said pipe having a mouth at its upper end, a trough connected to the upper end of said pipe, said trough being wider than the mouth of the pipe, the free upper edge of said trough being located at a higher level than the mouth of said outlet pipe, a lid provided with a closed top surface and fastened above said mouth, said lid being wider than the mouth but smaller than the trough, the lower edge of said lid being located below the upper edge of the trough to prevent the formation of an air whirl in the outlet pipe while the trough is filled with water, and a sieve extending from and about the periphery of said lid and extending between said lid and the bottom of said trough, said sieve surrounding the mouth of the outlet pipe and being provided with perforations, characterized in that the relation between the total area of the perforations of the sieve and the cross-sectional area of the outlet pipe is between 2.5 and 3.5.

* * * * *